United States Patent [19]

Heaney

[11] Patent Number: 4,722,168

[45] Date of Patent: Feb. 2, 1988

[54] PRODUCT-OUT-OF-REGISTRATION CONTROL FOR HIGH SPEED WRAPPING MACHINE

[75] Inventor: Steven R. Heaney, Shoreview, Minn.

[73] Assignee: Doboy Packaging Machinery, Inc., New Richmond, Wis.

[21] Appl. No.: 66,255

[22] Filed: Jun. 25, 1987

[51] Int. Cl.[4] ..... B65B 9/06; B65B 57/14; B65B 65/08

[52] U.S. Cl. ..... 53/450; 53/51; 53/55; 53/75; 53/77; 53/550

[58] Field of Search ..... 53/450, 51, 373, 55, 53/501, 75, 76, 77, 550

[56] References Cited

U.S. PATENT DOCUMENTS

| | | | |
|---|---|---|---|
| 3,269,086 | 8/1966 | Cloots et al. | 53/550 |
| 3,338,023 | 8/1967 | Lazenby | 53/550 X |
| 3,417,544 | 12/1968 | Grevich | 53/550 |
| 3,513,629 | 5/1970 | Hoagland et al. | 53/550 |
| 4,035,984 | 7/1977 | Gerlach et al. | 53/450 |
| 4,381,637 | 5/1983 | Ballestrazzi et al. | 53/550 X |
| 4,506,488 | 3/1985 | Matt et al. | 53/55 |
| 4,525,977 | 7/1985 | Matt | 53/55 |
| 4,549,386 | 10/1985 | Wilson | 53/550 X |
| 4,574,566 | 3/1986 | Eaves et al. | 53/450 |

*Primary Examiner*—Horace M. Culver

*Attorney, Agent, or Firm*—Orrin M. Haugen; Thomas J. Nikolai; Frederick W. Niebuhr

[57] ABSTRACT

A method and apparatus for increasing the performance and through-put of a high speed horizontal wrapping machine of the type having mechanically independently driven infeed, film drive and cut/seal head motors, each controlled by a shared programmed microprocessor whereby in the event that a product to be wrapped gets out of registration to the point where the machine's cut/seal head blades might otherwise engage the product being wrapped rather than only the film between two adjacent products, the condition is sensed and a software routine is called which causes the cut/seal heads to come to a stop in the open condition while the film tube continues to be fed until all the products, including the one out of registration and all those downstream from it, exit the wrapper, at which point the wrapper resumes its normal running mode. In this fashion, damage to the cut/seal head and associated downtime to clear the jam is avoided.

4 Claims, 6 Drawing Figures

PRODUCT-OUT-OF-REGISTRATION CONTROL FOR HIGH SPEED WRAPPING MACHINE

BACKGROUND OF THE INVENTION

I. Field of the Invention

This invention relates generally to high speed packaging machinery and more particularly to an improvement to a microprocessor controlled horizontal wrapper where product-out-of-registration conditions can be sensed and automatically cleared without damage to the cut/seal heads and without manual intervention.

II. Discussion of the Prior Art

In the Eaves et al U.S. Pat. No. 4,574,566 there is described a microprocessor-based control system for a horizontal wrapping machine. As has been pointed out in the "Background of the Invention" section of that patent, in a horizontal wrapping machine, a continuous film of packaging material is supplied from a roll and drawn past a film former which shapes the film into a continuous tube of packaging material. Products to be wrapped are supplied from a flighted infeed conveyor through the former and into the tube of packaging material such that the products are appropriately spaced from one another within the tube as the tube is drawn through heated finwheels. The finwheels not only act to draw the film from its supply reel and over the former, but also simultaneously creates a continuous longitudinal seal between the opposed side edges of the film tube. A transversely extending rotatably mounted blade and anvil at a cutting and sealing station cooperate with one another and with the tube of packaging material passing between them to create a transverse seal between adjacent entubed products while also severing the tube into discrete packages. Finally, the packaged products are deposited on a discharge conveyor leading to a cartoning station or the like.

As is further explained in the Eaves et al U.S. Pat. No. 4,574,566, the disclosure of which is hereby incorporated by reference, the drive motors for the infeed conveyor, the finwheels, the cut/seal head and the discharge conveyor are electronically controlled by separate, closed-loop controllers which receive commands from a programmed microprocessor. The advantages of that system over then-existing prior art horizontal wrappers, where synchronism was maintained using drive shafts, clutches, brakes and similar mechanical linkages, is fully set out in the aforereferenced Eaves et al patent and need not be repeated here. Suffice it to say that the microprocessor-based architecture of the horizontal packaging machine affords significantly greater flexibility in the overall setup, initialization, running, and change-over upon different product selection than could be achieved using earlier, prior art systems.

One problem not addressed in the Eaves et al patent is the situation which occurs when a product falls out of registration with the supposedly synchronized operation of the cut/seal heads. In one recent application of the Servotronic TM wrapping machine, which is the equipment manufactured and sold by Doboy Packaging Machinery, Inc., applicant's assignee, and made in accordance with the Eaves et al U.S. Pat. No. 4,574,466, it was desired to wrap synthetic sponges in plastic film. The sponges, however, had a somewhat curved configuration and, on occasion, the lugs or pusher fingers on the flighted infeed conveyor would slide beneath the trailing end of the sponge. That is to say, the sponges would occasionally ride up on the pusher lugs and, thus, would no longer be in precise registration with respect to the rotation of the blade and anvil of the cut/seal head. This would lead to the blade and anvil coming together with the product sandwiched between and was a serious cause of premature failure of the cut/seal heads. Furthermore, such an event would require the shut down of the packaging machine while the fault condition was cleared. This necessarily detracted from the production rate for the machine.

The present invention provides a solution to that problem. More particularly, an additional photoelectric sensor in the form of a radiation transmitter disposed on one side of the film tube and a radiation sensor positioned in alignment with the transmitter, but on the opposite side of the film tube at a location near the finwheel assembly, which is a precisely measured distance upstream of the cut/seal head station is employed to look for the presence of a product in a "window" at timed instants. If proper registration exists, no product will be detected. However, if the sensor detects a product intercepting the beam at the sampling time, an out-of-registration condition exists and the sensor triggers the execution of a software routine which is capable of preventing the out-of-registration product from coming between the blade and anvil of the cut/seal head. Upon detecting an improperly positioned product, the software causes the wrapper to come to a synchronized stop with the anvil and blade in its opened orientation and to automatically clear all products contained within the film tube downstream of the former. Once the film tube is so cleared, the high speed wrapper is again be made to function in its normal running mode.

OBJECTS

It is accordingly a principal object of the present invention to provide an improved apparatus and method for operating a microprocessor-based horizontal wrapping machine.

Another object of the invention is to provide a software control algorithm for use in a microprocessor-based high speed wrapping machine which reacts to product-out-of-registration conditions for automatically clearing the fault condition without the need for manual intervention in most instances.

Yet another object of the invention is to provide an improved method of operating a high speed horizontal wrapping machine in such a way that damage to the cut/seal head assembly is obviated and machine downtime to clear malfunctions is significantly reduced.

BRIEF DESCRIPTION OF THE DRAWINGS

These and other objects and advantages of the invention will become apparent to those skilled in the art from the following detailed description of a preferred embodiment, especially when considered in conjunction with the accompanying drawings in which.

DESCRIPTION OF THE PREFERRED EMBODIMENT

Figure 1:
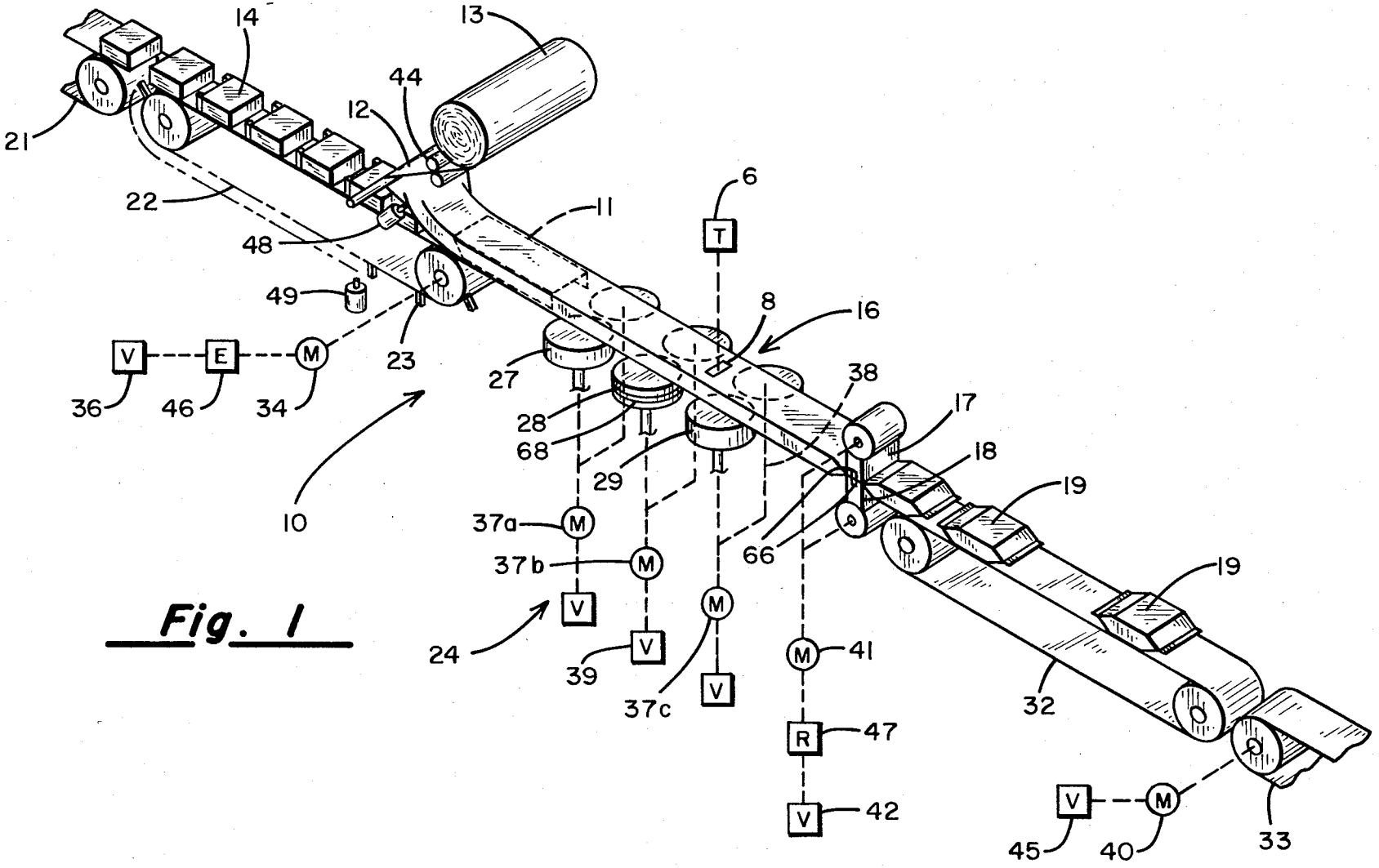
FIG. 1 is a schematic mechanical diagram of a microprocessor-based horizontal wrapping machine embodying the present invention.

Referring first to FIG. 1, there is shown a horizontal wrapping machine 10 including a film former 11 for shaping a continuous film 12 of packaging material which is drawn past the film former 11 from a roll of sheet film 13, which may be printed or unprinted. Products 14 to be wrapped are fed into the former 11 and carried within the packaging film tube 16 created by the passage of the film material over the former 11. The products 14 are carried within the tube 16 in a spaced apart relationship past a cutting/sealing station at which a pair of opposed sealing and cutting heads 17–18 cut and seal the film tube between products to form discrete sealed product packages 19.

The products 14 arrive at the film former from a supply conveyor 21 which functions to deposit the products between flights on an endless flighted conveyor 22 called the infeed conveyor. The infeed conveyor 22 is divided into flights by a series of regularly spaced pusher fingers 23 attached to the conveyor 22. Each product 14 is intended to be carried in a flight on the conveyor with its posterior or trailing end resting against a pusher finger 23. It has been found in some applications, however, that a product may rise up on a pusher finger and thus lose its necessary registration.

The products 14 are introduced into the interior of the tube 16 by moving the products through the interior of the former itself. Each product is then received on, and carried along by, the interior bottom surface of the film tube 16. A product may also lose registration if any slippage occurs within the tube.

The film tube 16 is shown as being formed into a generally rectangular shape, having its two edge portions formed into downwardly extending strips (not shown) which pass between a suitable drive arrangement such as a finwheel drive assembly or a band sealer. In FIG. 1, a series of three finwheel pairs 27, 28 and 29 is illustrated and each includes its own separate drive motor. The finwheels grip the downwardly extending adjacent pair of film edges. Each finwheel in each pair of finwheels rotates in an opposite direction, firmly gripping the film edges therebetween and thus moving the film tube 16 toward the cut/seal heads 17, 18. The middle pair of finwheels 28 are preferably heated to effect sealing of the edges of the thermoplastic film tube 16 together in a continuous longitudinal seal.

The now sealed tube 16 containing the spaced apart products 14 continues to be advanced by the finwheel drive assemblies past the cut/seal heads 17, 18. The cut/seal heads are rotated in opposite angular directions to normally meet and engage the film tube 16 after each product moves past the cutting and sealing station. The cut/seal heads, when in engagement with the film tube 16, move at substantially the same linear rate as the film and coact to compress the film tube together into a flattened condition.

Each of the cut/seal heads 17, 18 is heated and the compressed plastic film tube becomes transversely sealed as it is cut, thereby enclosing each product in an enclosed, sealed package. The resulting individual packages 19 are then carried from the cutting and sealing station by a discharge conveyor 32, which generally operates at a slightly higher rate than the rate of travel of the film tube 16. The packages 19 are then discharged onto a suitable receiving apparatus 33 which may, for example, lead to a cartoning machine where the individual packages are placed in boxes.

The infeed conveyor 22 is shown as being driven by a motor 34. The motor 34 is driven under closed-loop servo-control with an "actual velocity" feedback signal provided by a tachometer 36 coupled to the motor 34. Likewise, as indicated in FIG. 1, each of the finwheels 27, 28 and 29 has an independent drive motor therefore *37a*, *37b* and *37c*. The finwheel velocities and therefore the velocity of the film tube 16 is sensed by a tachometer 39 which provides information to the microprocessor-based control system, all as more particularly described in the aforereferenced Eaves et al U.S. Pat. No. 4,574,566.

It is of course important to obtain the proper orientation of each product 14 relative to a cut length of film, cut length being the amount of film used in each package 19. Moreover, it is important that the cut/seal heads 17 and 18 come together at the proper cut point between the products in the film tube. The film cut lengths are defined by printed marks called "eyespots" on the film 12 when the film material being used includes graphics and it is necessary to maintain registration between the product and the graphics on the wrapper. The spacing between the eyespots generally defines the cut length of the film. These eyespots are sensed by a sensor positioned proximate the film's edge to provide film position information to the control system for the horizontal wrapping machine.

Another sensor 49 is positioned to detect the passing of an infeed conveyor pusher finger and thus provides the microprocessor-based control system with information concerning pusher positioning. Knowing the film and pusher finger position information normally permits the products 14 to be in proper registration relative to the cut lengths of film and also with respect to the coming together of the blade and anvil of the cut/seal heads 17 and 18 in forming the product packages. However, as explained earlier, any shifting of the product relative to the pusher finger position or film position will result in an out-of-registration condition. A photo-transmitter 6 is positioned above (or below) a window 8 formed in a film support plate disposed beneath the film tube 16 and a photo-receiver (not shown) is disposed below (or above) the window so as to intercept the radiation emitted by the transmitter and passing through the transparent film unless blocked by an out-of-registration product.

Figure 2:
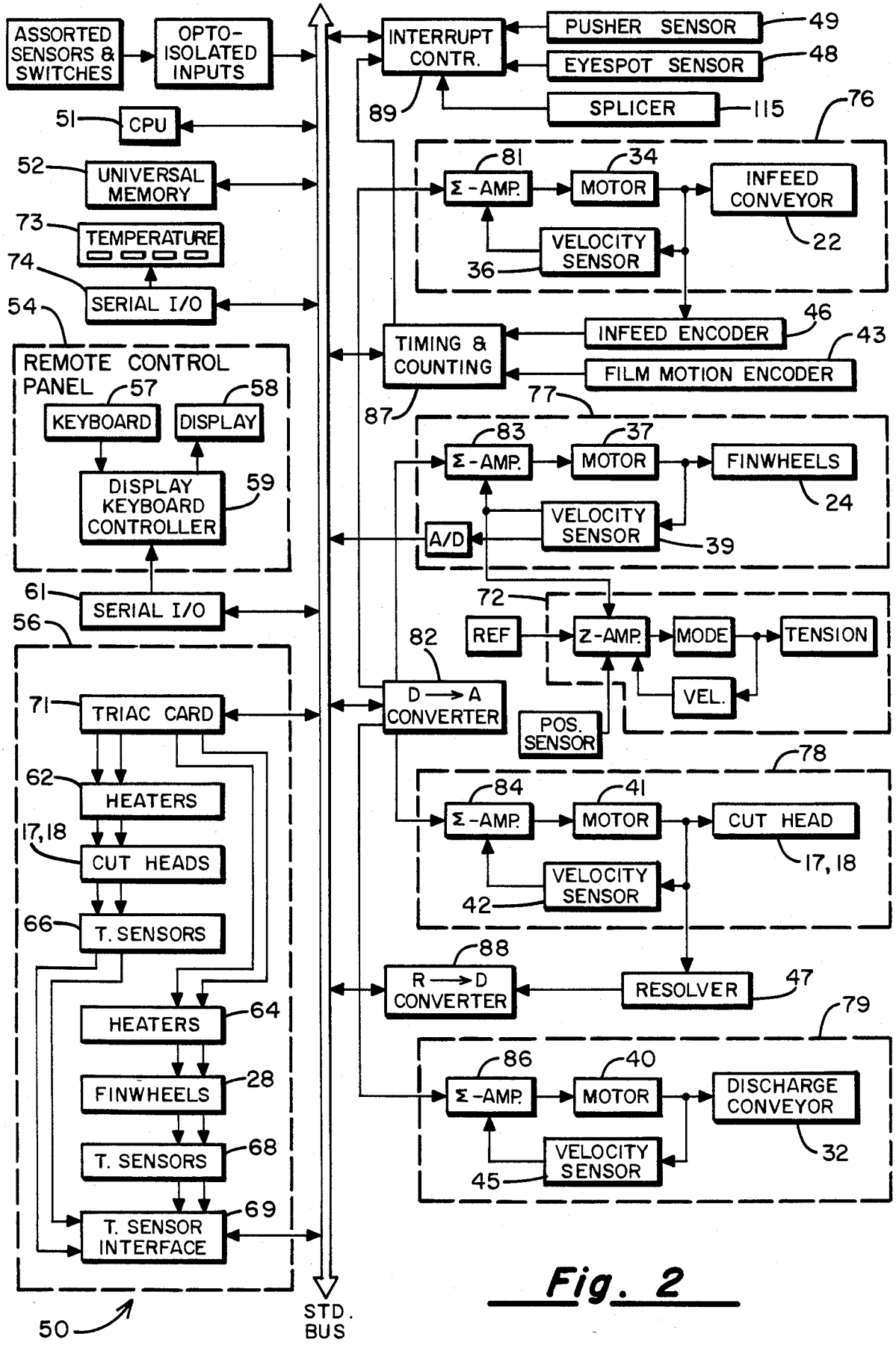
FIG. 2 is an electrical block diagram of the control system in which the present invention finds application.

With reference now to FIG. 2, the controller for the horizontal wrapping machine 10 is illustrated, in conjunction with certain of the controlled elements of the machine. The controller, indicated generally by numeral 50 is a microprocessor-based controller (MBC) including a central processing unit (CPU) 51 and a universal memory 52 coupled to a common bus 53.

The controller 50 includes an operator interface section 54 and a temperature control section 56. The operator interface section 54 includes a keyboard entry device 57 and an alpha/numeric display device 58 coupled through a display and keyboard control circuit 59 and a serial input/output circuit 61 to the system bus 53. A processor associated with the remote control panel 54 is operable to provide display prompts to the machine operator on the display 58 so that the operator can input desired machine operating parameters to the processor through the keyboard.

The temperature control section 56 includes circuitry for providing closed loop control of the heaters on the upper and lower cut/seal heads 17, 18 and the finwheels 28. The cut/seal heads and finwheels each contain heaters 62, 64 (not shown in FIG. 1), respectively. In addition, the cut heads and finwheels carry temperature sensors 66 and 68 respectively.

The outputs of the temperature sensors 66, 68 are coupled through a temperature sensor interface circuit 69 to the bus 53. The processor 51 provides heater activation signals to the heaters 62, 64 by way of the bus 53 through a triac output circuit 71. The heater activation signals are based upon the temperatures of the cut/seal heads and finwheels as provided by the temperature sensors 66, 68.

The temperature of the cut/seal heads and finwheels are presented by the processor 51 to a temperature display 73 through a serial I/O circuit 74 which is coupled to the bus 53.

The microprocessor-based controller 50 further includes an infeed conveyor motor servo control circuit 76, three finwheel motor servo controls (only one of which is identified as 77), film tension motor control 72, a cut/seal head motor servo control 78 and a discharge conveyor motor servo control 79. The infeed control 76 includes a summing-amplifier 81 which receives a desired infeed velocity signal from the processor 51, via the bus 53 and a digital-to-analog converter 82. As previously described, the feedback loop from the motor to the summing-amplifier is completed by a velocity sensor (tachometer) 36 which provides an actual infeed velocity signal to the summing-amplifier 81. Similarly, one of the finwheel servo circuits 77 includes a summing-amplifier 83 which receives a desired finwheel velocity signal from the processor via the digital-to-analog converter 82. The feedback loop is completed by a tachometer 39 which couples the finwheel motor speed to the summing-amplifier 83. The other two finwheel motor controls use current feedback as a means of controlling their respective motors.

The cut/seal head motor servo control circuit 78 includes a summing-amplifier 84, which receives a desired velocity signal from the processor via the digital-to-analog converter 82. The cut/seal head servo loop is completed by the tachometer 42 which is coupled to the summing-amplifier 84.

The discharge conveyor servo 79 includes a summing-amplifier 86, which receives a desired discharge conveyor motor velocity signal from the processor 51 by way of the digital-to-analog converter 82. The discharge conveyor servo loop is completed by the tachometer 45 which is coupled from the discharge conveyor motor output to the summing-amplifier 86.

The infeed encoder 46 indicative of infeed conveyor travel is coupled through a timing and counting circuit 87 and the bus 53 to the processor 51. The film motion encoder 43 indicative of film travel is also coupled through the timing and counting circuit 87 to the processor 51. The cut/seal head position sensor, i.e., the resolver 47, is coupled to the processor through a resolver-to-digital converter 88 via the bus 53.

The eyespot sensor 48 for detecting eyespots on the film 12 is coupled to an interrupt controller circuit 89 as is the pusher sensor 49 which senses the pushers on the infeed conveyor. The interrupt control circuit 89 also receives a signal from a film-splice eye 115. The interrupt control circuit 89 produces hardware interrupt signals to the processor via the bus 53 when the eyespot sensor senses an eyespot on the film, when the pusher sensor 49 senses a pusher on the infeed conveyor at the pusher sensor location and when the splicer eye 115 senses an eyespot. Interrupt routines are initiated based upon a counter in the circuit 87 coupled to the film motion encoder 43. Another interrupt routine is initiated based upon a one millisecond timer in the CPU 51.

The primary function for the controller 50 in the operation of the horizontal wrapping machine 10 is to maintain proper product/film flow. The control problem may be considered to be two distinct subproblems. The first is to cause each product to be oriented properly with respect to the eyespots on the film (product orientation). The second subproblem is to cause each cut to be oriented properly with respect to the eyespots (cut orientation). The plural motors, i.e., the infeed, tension, finwheel and cut/seal head motors, must be synchronized in order to provide these two necessary orientations to properly package a product. Film travel is used as the master input to control the synchronization of the product infeed and the cut/seal head movement.

The photo-transmitter 6 and its associated receiver used to sense for out-of-registration products in the area of the window 8 are included in the block labeled "Assorted Sensors and Switches" in FIG. 2 and that receiver is coupled through opto-isolated inputs to the CPU's standard bus. Rather than providing an interrupt signal to the CPU, as will be further explained with the aid of the flow charts of FIGS. 3(*a*)–3(*d*), the CPU periodically scans the condition of the receiver to determine if the window is free of a product.

The foregoing description of the preferred embodiment when coupled with the teachings of the Eaves et al U.S. Pat. No. 4,574,566 incorporated by reference herein are sufficient to permit those skilled in the art to understand the construction and mode of operation of the system generally. With that information as background, attention will next be given to the improvements made to that system whereby product-out-of-registration conditions can be sensed and automatically accommodated without materially degrading the machine's production rates or requiring human intervention.

Referring to FIGS. 3*a* through 3*d* there is shown by means of a software flow chart, the "product-out-of-registration" routine executed by the microprocessor-based controller. Because the detailed machine coding would necessarily vary, depending upon the particular microprocessor which may be employed in implementing the system, it is deemed unnecessary to present such machine coding herein. The detailed flow charts of FIGS. 3*a* through 3*d* will permit persons skilled in the art to write the machine code for a microprocessor whereby the various control functions can be accomplished.

In explaining the present invention, it is assumed that the reader is familiar with the disclosed subject matter of the aforereferenced Eaves et al U.S. Pat. No. 4,574,566 in terms of the system's normal mode of operation. Accordingly, it is not believed necessary to repeat that information here.

Figure 3A:
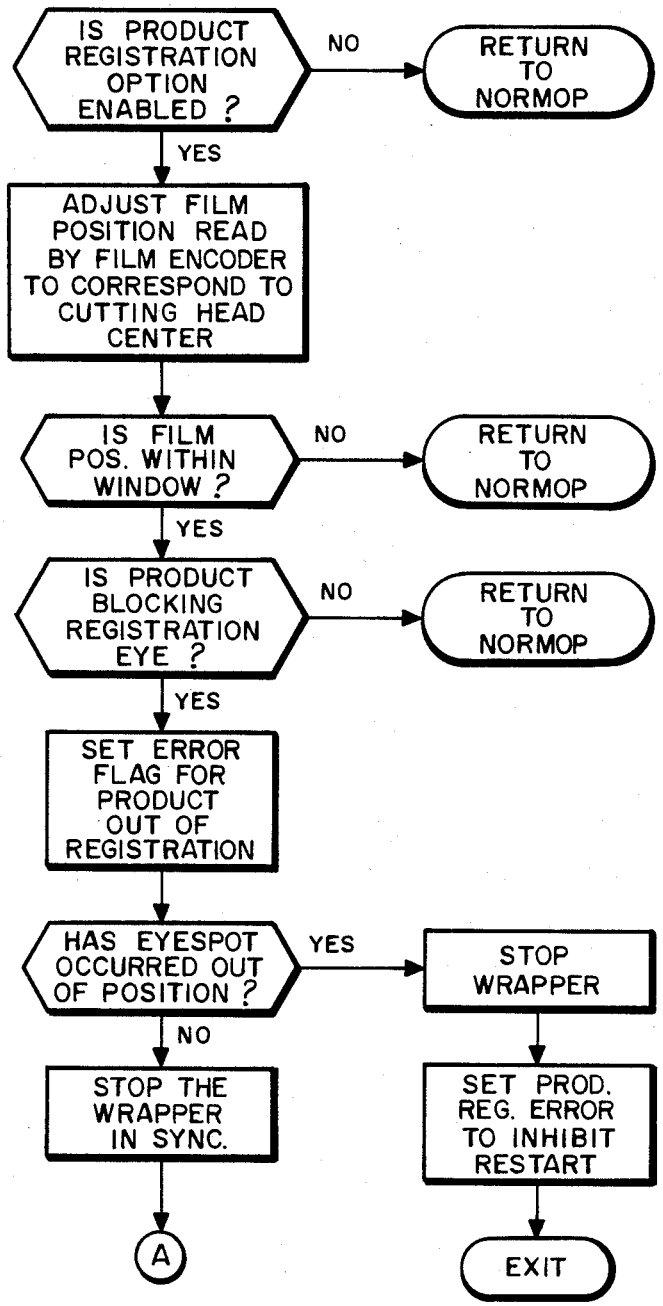
FIGS. 3*a* through 3*d* illustrate a software flow chart defining the control algorithm in accordance with the present invention.

Referring to FIG. 3*a*, the first step in the software sequence is for the microprocessor-based controller to determine whether the product-out-of-registration option is enabled. That is, has a flag been set to cause the software for sensing lack of registration and subsequent accommodation been activated. If not, the system returns to normal operation. If the option is activated, however, the next operation to be performed is to adjust the film position read by the encoder 43 so that the position corresponds to the center line of the cut/seal heads 17 and 18. A test is made on each pass through the software as to whether the film position is in alignment with the "window" 8 through which the radiation transmitter 6 is focused on the sensor. If a given cut length is not yet within this window, operation again returns to the normal run routine until a test on a subsequent cycle reveals that the film position is within the window at which point a test is made to determine whether the product is now blocking the registration eye. If not, it means that the product is appropriately in registration and control returns to the normal running sequence as explained in the aforereferenced Eaves et al U.S. Pat. No. 4,574,566. If, however, the passage of radiation through the window is blocked by the presence of a product, it means that the product is not in proper registration and an error flag is set. This error flag indicates to the software where in the routine control is then at, which becomes important in the event that some other operating condition crops up requiring an exit from the product-out-of-registration routine.

Having set the error flag, and as further indicated in FIG. 3*a*, a test is made to determine whether or not an eyespot preprinted on the film web is out of position. This may occur, for example, if a new roll of film has been spliced onto a previous roll so that the eyespots no longer are spaced as on the prior roll. Furthermore, on occasion, eyespots get misprinted by the film manufacturer resulting in a variation in the distance from eyespot to eyespot on the film. If such an "eyespot out of position" condition is detected, it is necessary to stop the wrapper for operator intervention. That is to say, if the eyespots are inappropriately positioned, the software routine of the present invention cannot operate to correct product-out-of-registration conditions. Upon stopping of the wrapper, however, a product registration error flag is set precluding the microprocessor-based controller from re-starting the machine. The flag must be cleared by a human operator.

Assuming, however, that the test indicates that the eyespot has not occurred out of its expected position, the microprocessor-based controller stops the wrapper in synchronization. In particular, the blade and anvil 17–18 are stopped in their open position with both the blade and anvil generally parallel to the direction of flow of product.

Figures 3B, 3D:
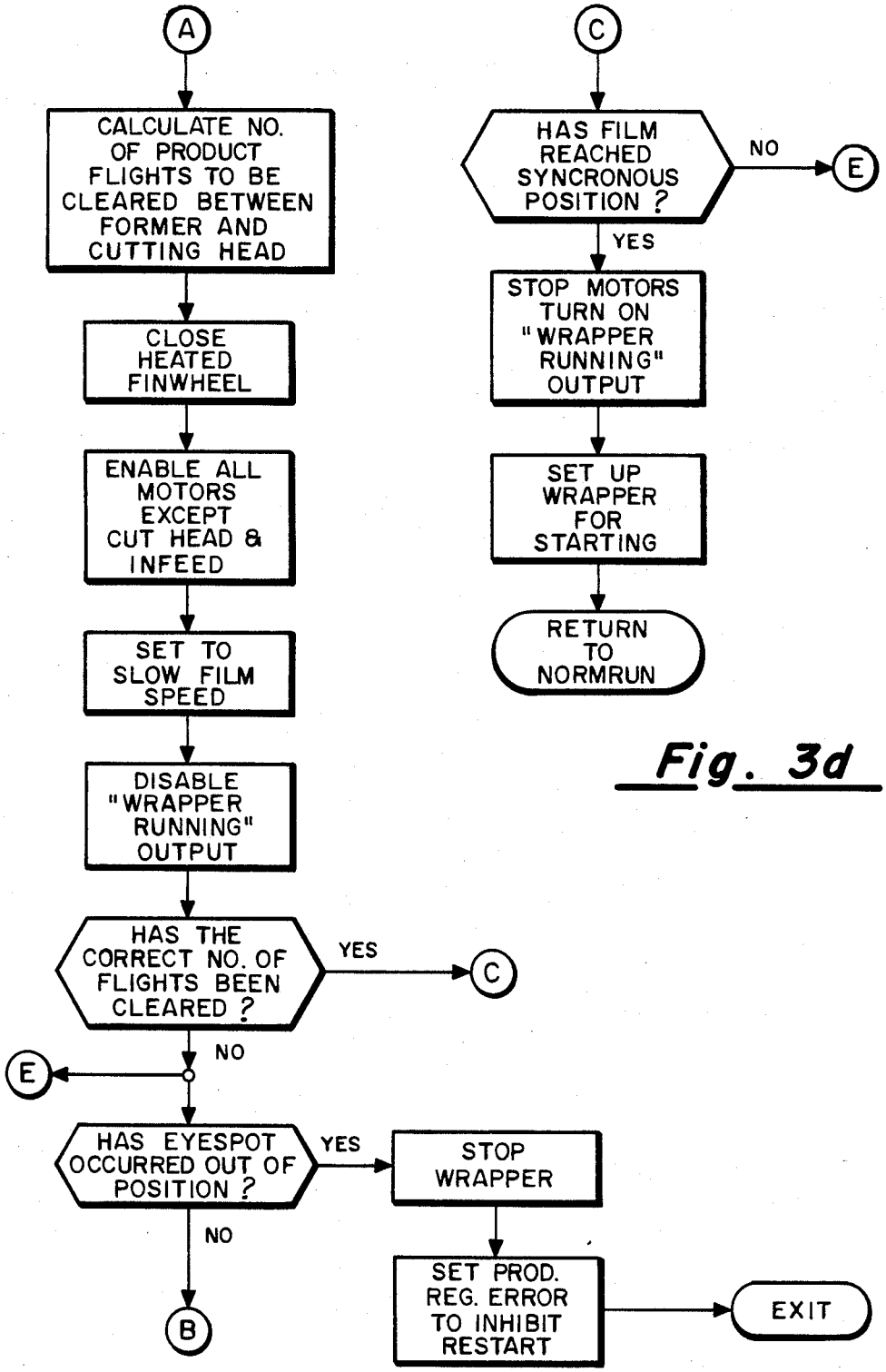

Referring to FIG. 3*b*, the next step in the program is for the microprocessor to calculate the number of product flights to be cleared between the location of the former and the center line of the cutting head. Here, it should be recalled that upon a set up of the machine, product length and cut length parameters are entered into the memory of the microprocessor and become available for executing this computation. Next, the heated finwheel pair 28 are closed onto the film edges (not shown) and then the motors 37*a*, 37*b* and 37*c* as well as the motor for the discharge conveyor are energized. At this time, however, the cut/seal head motor 41 and the infeed conveyor motor 34 are disabled. As such, no further product is introduced into the film tube as the products, including the one out of registration, clear the gap between the blade and anvil of the cut/seal station. The finwheel drive speed is set to operate at slower than normal and a signal is fed back to the product feeder 21 so that it no longer supplies product to the now-stopped infeed conveyor chain 22.

The film travel is monitored and a test is made to determine whether the computed number of products have cleared the cut/seal station. If so, control exits to the software shown in FIG. 3*d*. This sequence of operations illustrated in FIG. 3*d* re-establishes the proper film position with respect to the cutting head and the flights of the infeed conveyor. If the film has not yet reached its sync position, control exits to the entry point E shown in FIG. 3*b* and the eyespot out-of-position test is again repeated.

If the sync position has been reached, however, the motors are first stopped, an indicator reading "Wrapper Running" is reflected on the control panel and the wrapper is prepared for starting in the manner described in the Eaves et al patent, completing the automatic accommodation of product-out-of-registration.

It was earlier assumed that the correct number of flights had cleared the cut/seal station in the flow chart of FIG. 3*b*. If the test had revealed the contrary, the eyespot out-of-position test will again be executed. Then, where it is determined that the eyespot is not out-of-position, control exits to the connection point B in the flow chart of FIG. 3*c*.

First, a ramp is called to control the orderly acceleration of the finwheel motors. In that the microprocessor is simultaneously overseeing the execution of other routines, all as more particularly set out in the aforereferenced Eaves et al., U.S. Pat. No. 4,574,566, the "update" routine is called allowing the processing of other functions. Next, a check is made for any commands originating at the control panel and depending upon the results of that check, control falls through a series of tests with the subsequent operation depending upon the outcome of the test. For example, if the test reveals that there is a "stop command" present, the wrapper is stopped and a product registration error flag is set so that the machine cannot be restarted without also correcting the out-of-registration condition. If there was no stop command, but there is a command to sense status information to the control panel, various status information is transmitted and displayed on the control panel.

Figure 3C:
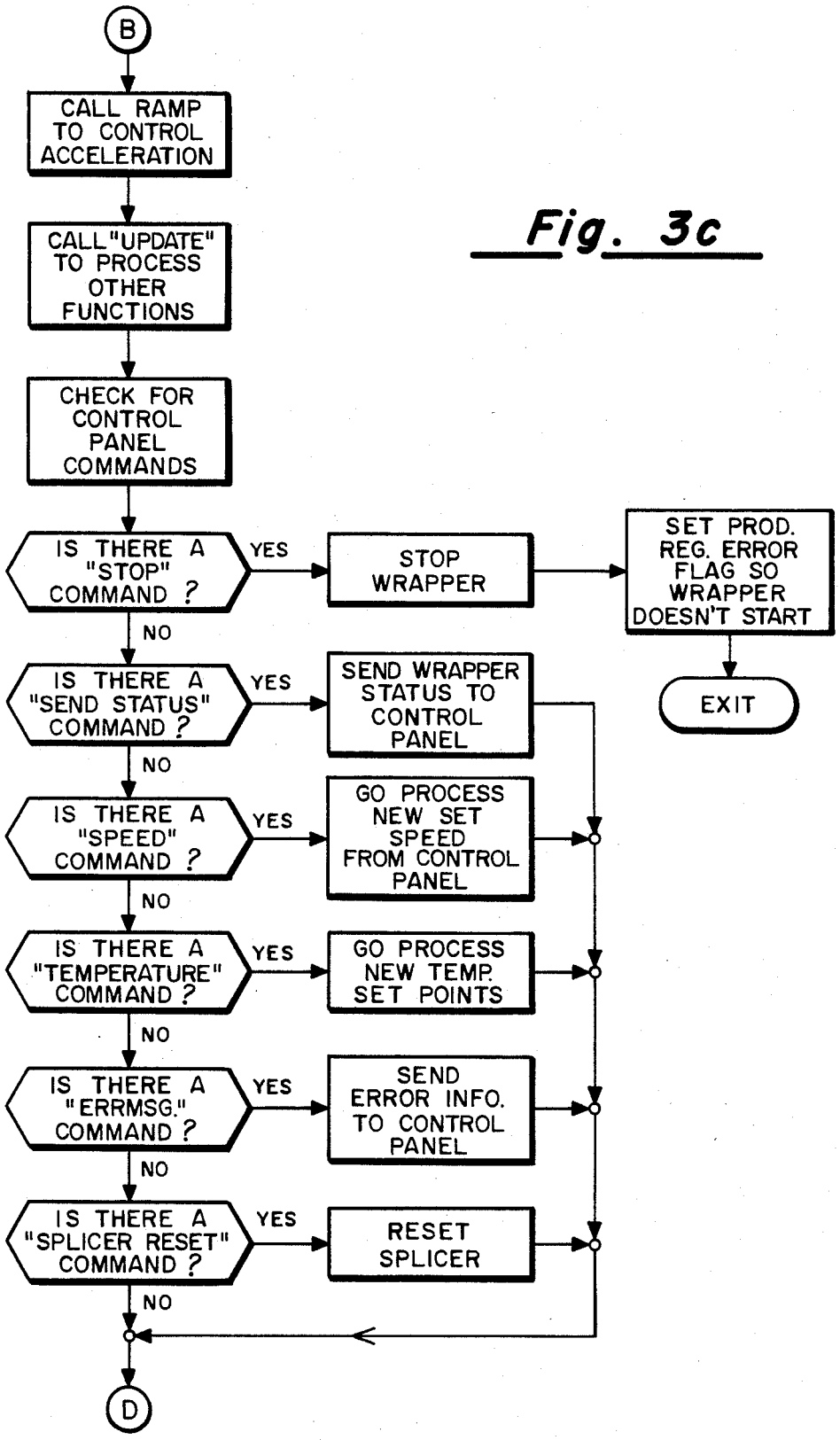

Having the foregoing examples in mind, the reader is in a position to fully understand the other tests and outcome determinative operations reflected in the flow chart of FIG. 3*c*. Then, following those tests and the execution of applicable operations reflected in the sequence of FIG. 3*c*, control returns to branch point D in FIG. 3*b*.

Once the film has reached its synchronized stop position, all motors are stopped as reflected in FIG. 3*d* and control exits to the NORM RUN mode, the details of which are explained in the aforereferenced Eaves et al U.S. Pat. No. 4,574,566.

By way of summary, then, it can be seen that the microprocessor-based wrapping machine is capable of detecting when a product has somehow lost its proper registration with respect to its time-of-arrival at the cut/seal station. Once this condition is detected, the microprocessor is made to execute a software routine which, normally without the need for manual intervention, causes the cut/seal heads to assume an open position and stop, followed by the feeding of the offending out-of-registration product and all other products contained within the tube between the former and the cut/seal station. Once this string of products has cleared the cut/seal station, the software again operates to bring the film tube into registration with the flights of the infeed conveyor and with the positioning of the cut/seal head so that upon resumption of normal operation, the high speed wrapper will again continue to dispense wrapped products without the possibility of products interfering with the appropriate closure of the cut/seal heads.

The invention has been described herein in considerable detail in order to comply with the Patent Statutes and to provide those skilled in the art with the information needed to apply the novel principles, and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A software method of operating a microprocessor controlled packaging machine of the type comprising means for drawing a web of film having registration marks printed thereon from a supply reel over forming means to create a film tube while simultaneously feeding products to be wrapped through said forming means to be carried by said film tube to a cut/seal station where blade and anvil means are intended to come together in an inter-product space to transversely cut and seal the film to create individual packages whereby said cut/seal heads, the product feeding means and said means for drawing said film are operated so as to prevent said blade and anvil means from contacting said products should said products lose spacial registration in the course of travel through said packaging machine comprising the steps of:

(a) sensing for the presence of a product at a predetermined location upstream of said cut/seal station at a time synchronized with the position of said blade and anvil;

(b) stopping the product feeding means, said film drawing means and said blade and anvil, leaving said blade and anvil open with respect to one another;

(c) computing the number of products in said film tube between said forming means and said cut/seal station;

(d) re-starting only said film drawing means and running same until the number of products computed in step (c) have passed between the opened blade and anvil;

(e) re-stopping said film drawing means when said film registration marks reach a predetermined position relative to said product feeding means following the occurrence of step (d); and (f) initiating the normal running mode of said microprocessor controlled wrapping machine.

2. The method as in claim 1 and further including the steps of:

(g) testing the position of said registration marks on said film; and (h) aborting steps (b) through (f) if the test of step (g) shows that said registration marks on said film has occurred out of normal position.

3. A method of wrapping products in packages formed from a continuous film of packaging material, with each package containing a cut length of film, comprising the steps of:

(a) shaping a continuous film of packaging material into a continuous tube by drawing the film past a former;

(b) drawing the continuous film of packaging material beyond the former and through a cutting and sealing station;

(c) feeding products to be packaged into the former and the continuous tube of packaging material at a predetermined rate;

(d) cutting and sealing the continuous tube of packaging material as each product moves past the cutting and sealing station;

(e) determining the relative orientation between each product and its associated cut length of film moving past the former;

(f) sensing for the presence of a product at a predetermined location upstream of said cutting and sealing station at a time synchronized with the position of the cutting and sealing means at said cutting and sealing station;

(g) stopping the product feeding means, the film drawing means and the cutting and sealing means leaving said cutting and sealing means apart relative to one another when step (f) finds a product at said location;

(h) determining the number of individual products contained in said film tube between said former and said cutting and sealing station when the result of step (f) finds a product at said location;

(i) re-starting only said film drawing means for a time interval sufficient to allow the computed number of products to pass through said cutting and sealing station;

(j) re-stopping said film drawing means when said film registration marks reach a predetermined position relative to said product feeding means; and (k) initiating the normal running mode of said microprocessor controlled wrapping machine.

4. A horizontal wrapping machine for wrapping products in packages formed from a continuous film of packaging material wherein each package contains a cut length of film, comprising:

(a) a former for shaping a continuous film of packaging material drawn past the former into a continuous tube;

(b) film drive means for drawing the continuous film of packaging material past the former and past a cutting and sealing station;

(c) product infeed means for feeding products to be packaged into said former and said continuous tube of packaging material;

(d) rotary cutting and sealing means disposed downstream of said former and including cooperating blade and anvil means for creating a transverse seal and cutting said continuous tube into discrete cut lengths, each containing a product;

(e) microprocessor-based controller means coupled to said film drive means, said product infeed means and said rotary cutting and sealing means;

(f) means for sensing the presence and absence of a product at a predetermined location upstream from said cutting and sealing means at a time synchronized with the movement of said blade and said anvil and providing a flag signal to said microprocessor-based controller means where unaltered operation of said film drive means and said cutting and sealing means would result in said blade and anvil contacting a product;

(g) said microprocessor-based controller means stopping said product infeed means, said film drive means and said means for cutting and sealing, leaving said blade and anvil open with respect to one another, and having means for computing the number of products in said film tube between said former and said cutting and sealing means;

(h) means responsive to the results of the computation for re-starting only said film drive means sufficiently long to have the computed number of products exit between said opened blade and anvil; and (i) means in said microprocessor-based controller means for re-initiating the normal running mode of said horizontal wrapping machine following the exit of the computed number of products between the opened blade and anvil.

* * * * *